US006806833B2

(12) United States Patent
Anderson

(10) Patent No.: US 6,806,833 B2
(45) Date of Patent: Oct. 19, 2004

(54) CONFINED PLASMA RESONANCE ANTENNA AND PLASMA RESONANCE ANTENNA ARRAY

(75) Inventor: Theodore R. Anderson, Galway, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 28 days.

(21) Appl. No.: 10/124,704

(22) Filed: Apr. 12, 2002

(65) Prior Publication Data

US 2003/0193436 A1 Oct. 16, 2003

(51) Int. Cl.[7] ..... H01Q 1/26
(52) U.S. Cl. ..... 343/701
(58) Field of Search ..... 343/701

(56) References Cited

U.S. PATENT DOCUMENTS 5,594,456 A * 1/1997 Norris et al. ..... 343/701
6,369,763 B1 * 4/2002 Norris et al. ..... 343/701
6,492,951 B1 * 12/2002 Harris et al. ..... 343/701

* cited by examiner

*Primary Examiner*—Michael C. Wimer
(74) *Attorney, Agent, or Firm*—James M. Kasischke; Michael F. Oglo; Jean-Paul A. Nasser

(57) ABSTRACT

A plasma antenna includes a plasma column formed of an ionizable gas. A modulating carrier frequency produces Hertzian dipoles within the plasma that radiate RF energy at the modulating carrier. The antenna, which produces these dipoles, can be short and still produce significant gain when the modulating carrier frequency and the natural resonance frequency of the plasma are substantially equal. Other aspects of the invention include a method to produce such plasma antenna and a product by process embodiment of the plasma antenna.

18 Claims, 3 Drawing Sheets

CONFINED PLASMA RESONANCE ANTENNA AND PLASMA RESONANCE ANTENNA ARRAY

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

This invention generally relates to radiofrequency (RF) antennas and more particularly to RF antennas that have a compact form.

(2) Description of the Prior Art

Conventional antennas radiate RF energy from a metallic conductor. The efficiency of such an antenna depends upon its length and configuration. Antennas that are approximately one-quarter wavelength ($\lambda/4$) for current fed antennas and one-half wavelength ($\lambda/2$) for voltage fed antennas or an integer multiple thereof can be tuned to have a low VSWR with a gain that is a strong function of antenna length. Conversely, as antennas become shorter they have lower gain. When the length becomes shorter than a single quarter or half wavelength, VSWR increases, and antenna efficiency decreases.

For variable frequency applications it is typical to design an antenna for a center frequency and to use various tuning methods to match the characteristic impedance of the radiating element or elements to a predetermined transmitter output impedance. Marine vessels antennas often cannot accommodate quarter-wave or half-wave antennas due to space restrictions. So the antenna radiating element is merely a stub that attaches to a tuning circuit. Such stubs can be difficult to tune and have little or no gain. Marine vessels, also incorporate one or more antenna masts that carry a number of diverse antenna structures. For such applications an antenna design must provide adequate gain within available space and must be capable of operating with physically proximate antennas at other frequencies. Antennas with short radiating elements typically interact in arrays.

Plasma antennas constitute another type of radiating structure. For example, U.S. Pat. No. 3,544,998 (1970) to Vandenplas discloses a plasma coated antenna. An expandable sheath consisting almost entirely of positively charged ions acts electrically like a vacuum to isolate the antennas from a layer of plasma which encompasses the antenna. The plasma layer may be maintained over the antenna by a suitable container. The antenna may be selectively tuned by varying either the thickness of the sheath or the density of the plasma.

U.S. Pat. No. 3,914,766 (1975) to Moore discloses a pulsating plasma device. This device has a cylindrical plasma column and a pair of field exciter members disposed in spaced parallel relationship to the plasma column. Means are also provided for creating an electrostatic field through which oscillating energy is transferred between the plasma column and the field exciter members.

Still other antenna structures exist. For example, United States Statutory Invention Registration No. H653 (1989) of Conrad discloses a superconducting, superdirective antenna array. A superconductive material is employed for the elements of the array which are arranged in a uniform half-wave dipole having a low ohmic resistance and a very high radiation efficiency. The superdirective antenna array is a linear array with element spacing of less than $\lambda_0/2$ where $\lambda_0$ is the center frequency of the dipoles. A dielectric window directs radiation of a very high directivity from the superconducting, superdirective antenna array.

U.S. Pat. No. 3,665,476 (1972) to Taylor discloses a receiving antenna for submarines. Tunnel diodes are inductively coupled to a plurality of ferrite rods by a coupling link. The tunnel diodes are back biased circuit to establish operation in the negative resistance region. Bias current and coupling are adjusted to provide cancellation of the major portion of the ferrite core losses and cover losses of the main turning winding.

Each of the foregoing disclosed antenna structures has certain disadvantages. Specifically, each generally tends to operate at a particular frequency, not over a wide bandwidth. Moreover each usually requires use of significant space and therefore is not readily adapted for installation on an antenna mast or like supporting structure in a confined volume. Finally when such conventional antennas are located in an array, they tend to be interactive in the far field radiation. What is needed is an efficient, tunable, compact antenna structure that has a wide bandwidth and that operates independently of far field radiation from adjacent antennas in an array on a common antenna mast, particularly on marine vessels.

SUMMARY OF THE INVENTION

Therefore it is the object of this invention to provide an antenna that is compact in design and adapted for use in a variety of applications.

Another object of this invention is to provide a tunable antenna that is compact in design and is adapted for use in a variety of applications.

Still another object of this invention is to provide an antenna that provides improved radiation at lengths less than a quarter-wavelength or half-wavelength of the frequency being radiated.

An antenna constructed in accordance with this invention includes a confined plasma column that extends along an axis and that is characterized by a natural resonance frequency. A modulator applies an ac field to the confined plasma column at a frequency essentially corresponding to the natural resonance frequency whereby the plasma radiates RF energy at the frequency of the ac field.

In accordance with another aspect of this invention, an antenna array comprises at least first and second plasma antennas. The first plasma antenna comprises a first confined plasma column that extends along a first axis and is characterized by a first natural resonance frequency. A modulator applies an ac field to the confined plasma column at a frequency essentially corresponding to the first natural resonance frequency. The second plasma antenna comprises a second confined plasma column extending along a second axis. The second plasma column is characterized by a second natural resonance frequency that is different from the first natural resonance frequency. A modulator applies an ac field to the second confined plasma column at a frequency essentially corresponding to the second natural resonance frequency. When the first and second antennas are mounted in an array, the antenna with the much lower natural plasma frequency is unaffected by radiation from the other antenna.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
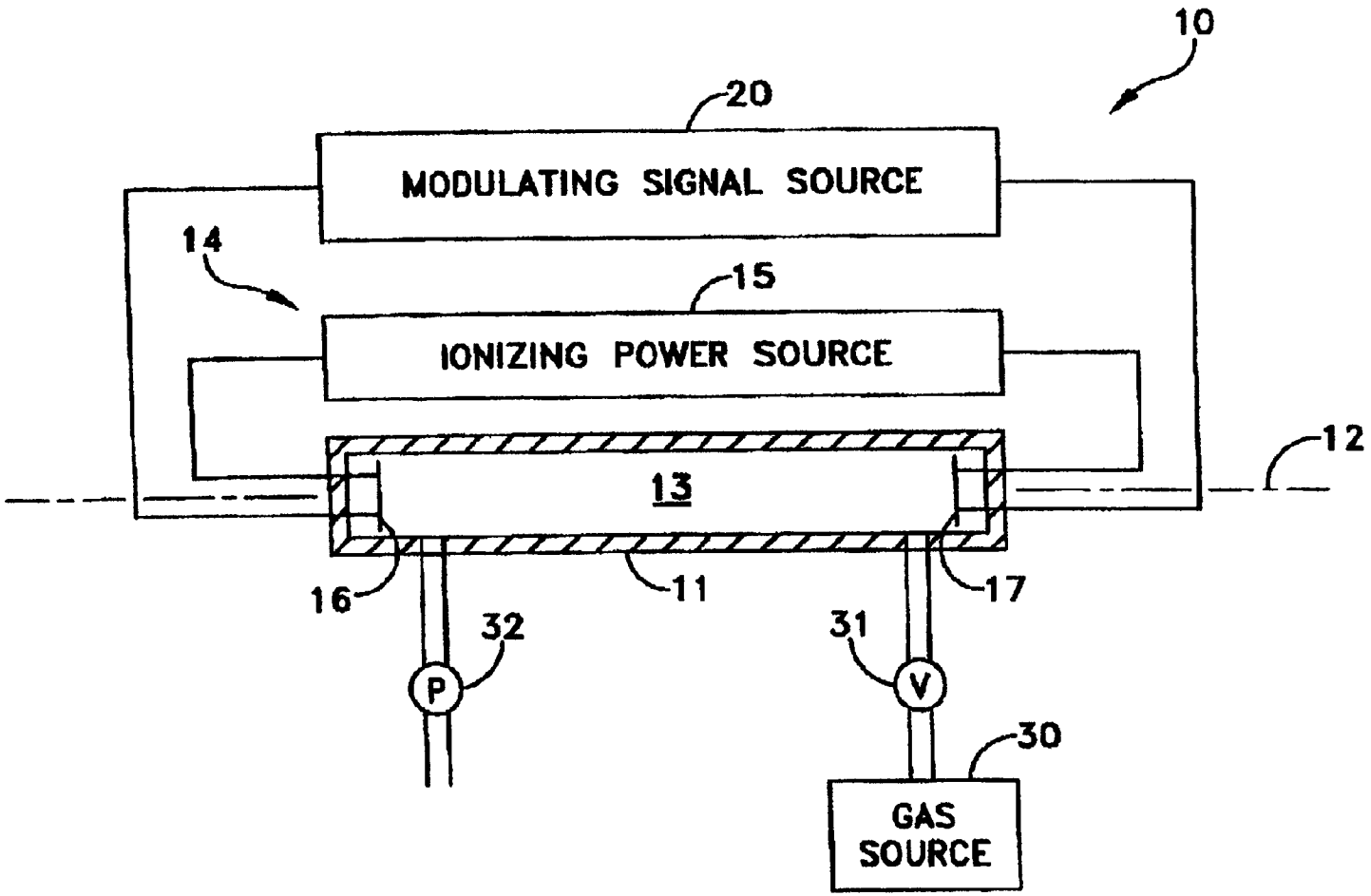
FIG. 1 is a diagrammatic depiction of a confined plasma column antenna constructed in accordance with this invention.

FIG. 1 depicts an antenna 10 for radiating RF energy constructed in accordance with this invention. It includes a pressure vessel 11 of any nonconductive material that extends along an axis 12. A typical pressure vessel 11 is cylindrical and extends along the axis 12. An ionizable gas 13 fills the pressure vessel 11. A discrete ionizing source 14, such as a dc source 15, establishes a dc field across internal electrodes 16 and 17 disposed at opposite ends of the pressure vessel 11. When the dc source 15 creates a sufficient potential between the electrodes 16 and 17, the gas 13 ionizes and produces unbounded electrons in a plasma. This plasma has a natural resonance frequency. The combination of the pressure vessel 11, ionizable gas 12 and the ionizing source 14 constitute a confined plasma column that extends along the axis 12 and is characterized by a natural resonance frequency.

Figure 2:
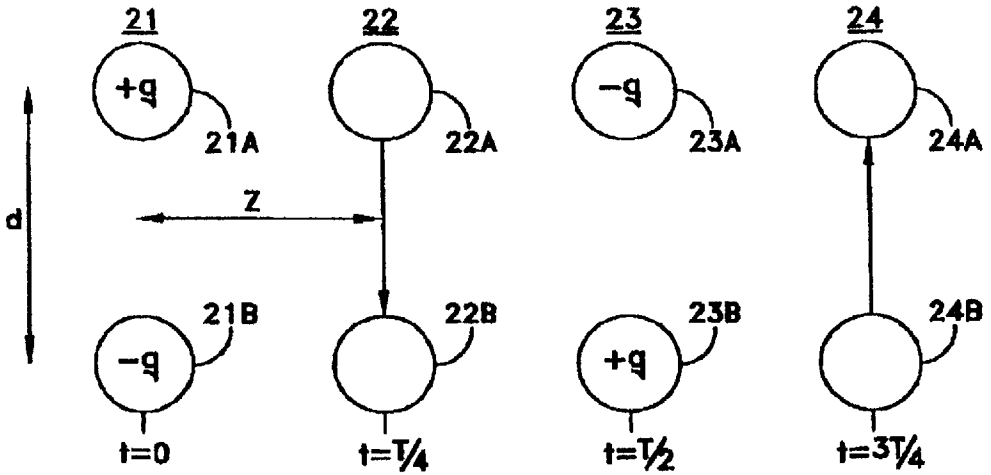
FIG. 2 is a diagram useful in understanding the operation of the antenna in FIG. 1.

In this embodiment a modulating signal source 20 connects to electrodes 16 and 17 in a way to be isolated from the dc source 15. The modulating signal source 20 produces an ac field along the axis 12. The frequency of the ac field causes each pair of charged particles to act as a Hertzian dipole which oscillates at the frequency of the applied ac field. FIG. 2 depicts four such charged particle pairs 21, 22, 23 and 24 lined up transversely along the axis. This analysis has been determined to be effective in frequencies as low as ELF frequencies.

FIG. 2 provides a basis for understanding both temporal and spatial resolutions and concepts. From a temporal viewpoint, FIG. 2 discloses one Hertzian dipole at four successive intervals over one cycle of the natural resonance frequency represented by time marks t=0, t=T/4, t=T/2 and t=3T/4. The dipole particles at 21A and 21B are at time t=0 and have maximum, but opposite charges +q and −q, respectively. One quarter wavelength later at t=T/4, the charges balance with a charge transfer from the particle shown at 22A to the particle shown at 22B. This is the beginning of a charge reversal that reaches a maximum state at t=3T/4 when the particles at 23A and 23B have charges −q and +q, respectively. At 3T/4 a charge transfer is occurring from the particle at 24B to the particle at 24A.

From a spatial standpoint, FIG. 2 depicts four adjacent dipoles spaced along the x axis corresponding to axis 12 (FIG. 1). FIG. 2 depicts a spacing "d" between individual particles in a pair such as particles 21A and 21B. FIG. 2 also depicts an average spacing "z" along the x axis between adjacent particle pairs, such as the particle pair 21A–21B and the particle pair 22A–22B.

Figure 3:
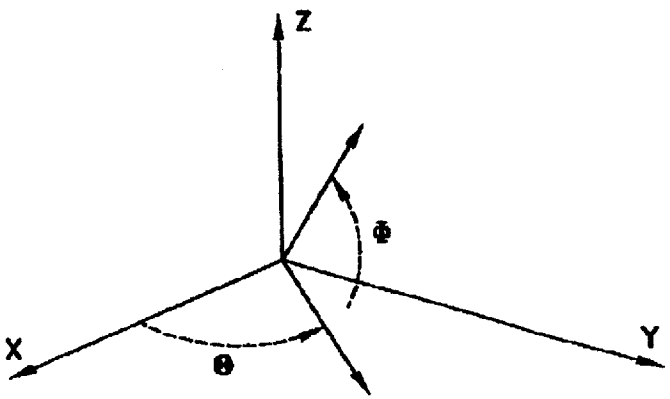
FIG. 3 is a diagram useful in understanding the theory of operation for the ahtenna in FIG. 1.

It is now possible to discuss the quantitative operation of a plasma antenna such as the plasma antenna 10 in FIG. 1. In addition to the diagram in FIG. 2 it is also helpful to define several axes and symbols. FIG. 3 depicts orthogonal X, Y, and Z axes. θ is an angle in the X-Y plane and φ is an angle of elevation from the X-Y plane. The X axis corresponds to the axis 12 in FIG. 1. Specifically modeling charged particle pairs as shown in FIG. 2 as Hertzian dipoles, the total radiated field from the antenna is the summation of the fields radiated by each individual dipole. More specifically, the force $\vec{F}$ on an electron in a time varying, harmonic electric field $\vec{E}$ is given as:

$$\vec{F}=-e\vec{E} \tag{1}$$

where $e=1.6\times10^{-19}$ C.

This force can also be expressed as:

$$\vec{F}=m\frac{d^2x^2}{dt^2}=-m\omega^2\vec{x} \tag{2}$$

where "$\vec{x}$" is the vector from a charged particle to its equilibrium position, "m" is the electron mass and "ω" is the angular acceleration of the charged particle.

The dipole moment, $N_{dip}$, for a single dipole is the product of, "q", on a particle times the distance, "d", to the other charged particle in a dipole. That is:

$$N_{dip}=qd. \tag{3}$$

As also known the dipole moment per unit volume, $\vec{p}$, is:

$$\vec{p}=-\frac{Ne^2}{m\omega^2}\vec{E} \tag{4}$$

and the electromagnetic displacement vector, $\vec{D}$, is given as:

$$\vec{D}=\varepsilon_0\vec{E}+p=\varepsilon_0\vec{E}-\frac{Ne^2}{m\omega^2}\vec{E}. \tag{5}$$

Combining and simplifying equations (1) through (5) yields:

$$\vec{D}=\varepsilon_0\left[1-\frac{\omega_p^2}{\omega^2}\right]\vec{E} \tag{6}$$

where "$\omega_p$" is the natural resonance frequency of the plasma that is given by:

$$\omega_p=\sqrt{\frac{Ne^2}{m\varepsilon_0}}. \tag{7}$$

Looking at the dipole pair represented by the particle pair 21Q–21B in FIG. 2, the dipole moment of particle 21A with respect to particle 21B is "qd". Mathematically, the IL product for these miniature dipoles is given as:

$$I\Delta z=j\omega p \tag{8}$$

where Δz represents the average dipole spacing along the x axis and where $$p=q\Delta z \tag{9}$$

As also known, the orthogonal electric field component, $\vec{E}$, and magnetic field component, $\vec{H}$, for a Hertzian dipole are given as:

$$\vec{E} = \hat{\theta}\sqrt{\frac{N}{\varepsilon}}\, j\frac{kI\Delta z e^{jkr}}{4\pi r}\sin\theta \tag{10}$$

and $$\vec{H} = \hat{\phi} j\frac{kI\Delta z e^{-jkr}}{4\pi r}\sin\theta \tag{11}$$

where "r" is the average radius to a charged particle from an origin in FIG. 3.

The wave impedance is given by:

$$\eta = \sqrt{\frac{\mu}{\varepsilon}} \tag{12}$$

and the distance between the charged particles is:

$$\text{spacing} = \sqrt[3]{\frac{1}{n}} \tag{13}$$

where "n" is the density of the unbounded electrons or other charged particles in the plasma. The value "n" defines the natural resonance frequency for the plasma, given by:

$$\omega_p 2\pi\sqrt{\frac{n(1.6*10^{-19})^2}{(9.11*10^{-31})(8.85*10^{-12})}}\,. \tag{14}$$

For a density of $n=10^{18}$ electrons per cubic meter, the natural resonance frequency of the plasma is 900 MHz. As also known the Poynting vector is for a pair of charged particles is:

$$\begin{aligned}\langle s\rangle &= \frac{1}{2}\mathrm{Re}\left[\vec{E}\times\vec{H}\right] \\ &= \hat{r}\frac{1}{2}\sqrt{\frac{\mu}{\varepsilon}|H_\theta|^2} \\ &= \hat{r}\frac{\mu}{2}\left(\frac{k|I|\Delta z}{4\pi r}\right)^2\sin^2\theta\end{aligned} \tag{15}$$

Equation 15 is summed over each possible charged particle pair in the antenna to determine net radiation pattern from the plasma column.

An antenna constructed in accordance with this invention and a conventional antenna will exhibit similar gain and efficiency so long as the length is an integer number of quarter or half-wavelengths. Thus for a short antenna the gain from a plasma antenna of this invention exceeds the gain of a conventional antenna of comparable length. Consequently at such antenna lengths usually required in marine vessel applications the plasma antenna is more efficient.

An analysis of the equations particularly equations (13) and (14) determines that the plasma antenna shown in FIG. 1 is easily tunable by changing the number of unbounded charged particles within the housing 11. Such changes can be accomplished either by varying pressure or varying the ionizing field. FIG. 1 depicts a gas source 30 with a control valve 31 that selectively admits ionizing gas in 13 into the pressure vessel 11. A vacuum pump 32 can exhaust ionizing gas from the chamber 11. The tuning frequency of the antenna 10 shown in FIG. 1 then can be increased by allowing gas to enter the chamber 11 from the gas source 30 through the valve 31 while blocking any exhaust through the vacuum pump 32. Conversely, the natural resonance frequency can be reduced by operating the vacuum pump 32 while the valve 31 is closed.

Figure 5:
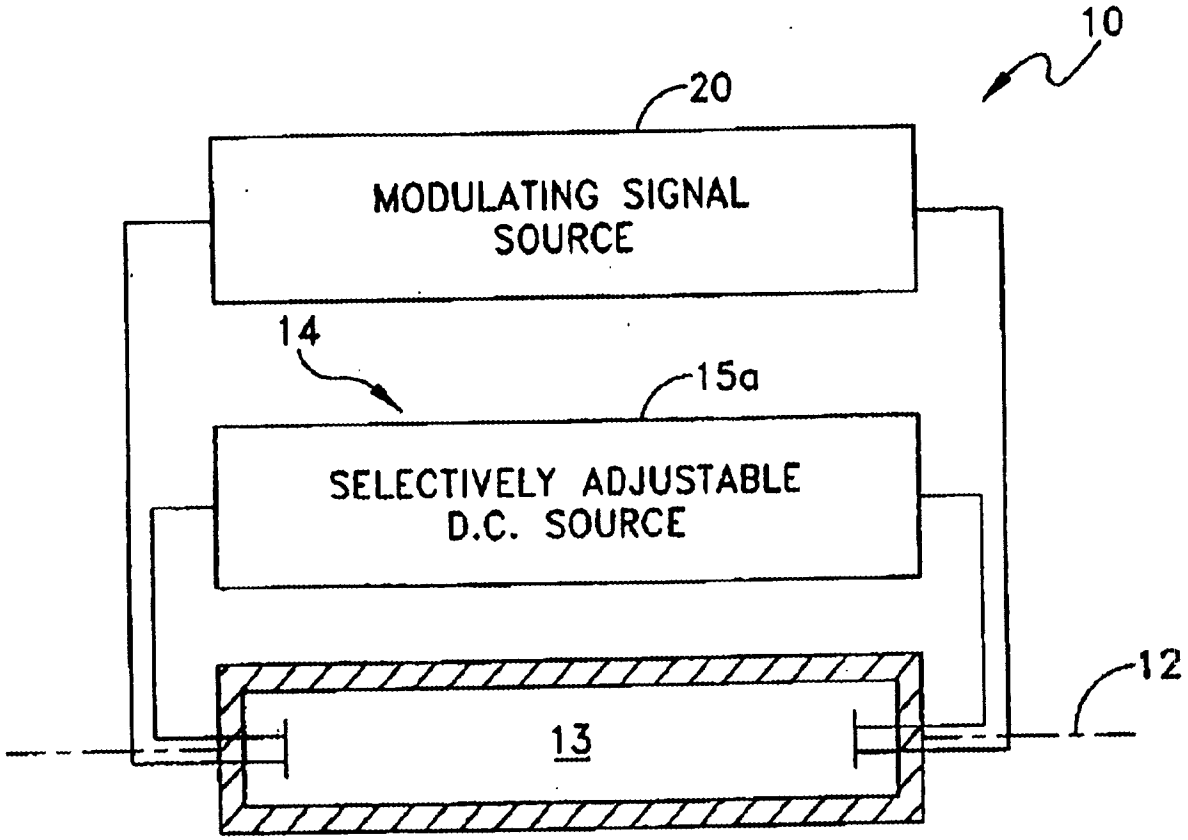
FIG. 5 is a diagrammatic depiction like FIG. 1 for and alternate embodiment of the invention.

Changes in the numbers of unbounded charged particles in the plasma can also be altered if the dc source 15*a*, FIG. 5 changes the potential applied across the electrodes 16 and 17. Increasing (i.e. selectively adjusting to increase the ionizing potential increases the number of charged particles that can combine with other charged particles to act as Hertzian dipoles. It will be apparent either of these approaches for a tuning can be implemented in a relatively simple manner and might be implemented independently or in conjunction with each other.

Still referring to FIG. 1, the ionizing gas 13 can comprise any ionizable gas including air and the inert gases. Neon and argon are preferred ionizing gases.

Figure 4:
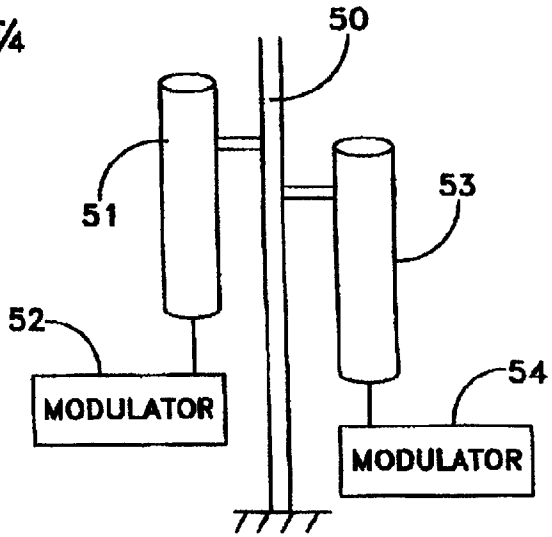
FIG. 4 depicts, in schematic form, a two-antenna array constructed in accordance with another aspect of this invention.

The modulating signal source 20 can be any ac or dc source. For example, the modulating signal source may apply an am or fm signal with a carrier at the natural resonance frequency. FSK or other binary modulation might also be used on a carrier. Still other such as laser-based or acoustic-based systems can apply the necessary ac field to produce radiation from the plasma. FIG. 1 also depicts an ionizing power source 15 and an independent modulating signal source 20. In certain circumstances these two functions might be combined. Gain from the antenna shown in FIG. 1 is also a strong function of the relative frequencies from the modulating signal source 20 and the natural resonance frequency of the plasma 13. The gain of the radiated RF signal decreases as the difference between the modulating frequency and the natural resonance frequency increases. This feature is particularly advantageous when multiple plasma antennas mount in an array. FIG. 4 shows one simple example with an antenna mast 50. A first plasma antenna 51 constructed as shown in accordance with the principles of FIG. 1 mounts to the antenna mast 50 and is driven by a first modulator 52. A second antenna 53 mounts to the antenna mast 50 and is driven by a second modulator 54. Assume that the natural resonance frequency of the antenna 51 is significantly greater than that of the antenna 53. For maximum efficiency the modulator 52 will operate at that natural resonance frequency which will be higher than the operating frequency for the modulator 54.

The lower the relative density of the plasma antenna compared to a neighboring plasma antenna, the more invisible it is. This is partly due to the increase in skin depth of the plasma as the plasma density or plasma frequency is decreased. The plasma skin depth is equal to the speed of light divided by the plasma frequency. It is characteristic of these plasma antennas that the lower density of the plasma in the antenna 53 makes the antenna 53 "invisible" to the far field radiation from the antenna 51. There is far field interaction between the field radiated from the antenna 53 and the plasma in the antenna 51. However, the difference between the natural resonance frequencies of the plasma in the antenna 51 and the antenna 53 attenuates any far field interaction in the antenna 51. This particular feature of non-interaction in the far field is extremely beneficial when multiple antennas mount to a common antenna mast in a multiple antenna array.

As will now be apparent, an antenna constructed in accordance with this invention will provide satisfactory radiation levels even when the overall length of the antenna is a fraction of a wavelength because the plasma antenna produces superior gain in such situations. The antenna is readily tunable so it is adapted to a wide variety of applications. These advantages accrue because gain is not directly related to length in such antennas but rather to the match between the modulating frequency and the natural resonance frequency of the plasma column.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A method for producing a confined plasma column type antenna, comprising:

providing an elongated pressure vessel made of nonconductive material which has a longitudinal axis;

providing a pair of electrodes within said pressure vessel, which respectively are disposed at one and the other of opposite ends of the pressure vessel;

introducing into and confining within said pressure vessel an ionizable gas which in its ionized state in said pressurized vessel has a predetermined pre-adjusted natural resonance frequency;

to cause the ionizable gas to be in its ionized state concurrently applying a dc potential across the electrodes and an ac electric field to the column of gas within the elongated pressure vessel, said electric field being applied to said column of gas along the longitudinal axis, said ac electric field having a frequency essentially corresponding to said pre-adjusted tuned natural resonance frequency; and adjusting the potential applied across the electrodes to further tune the natural resonance frequency of the confined plasma column antenna to reduce the difference between said pre-adjusted natural resonance frequency and the frequency of said ac electric field applied to the antenna to tune said confined column of gas for increased gain as an antenna.

2. The method as recited in claim 1 wherein the ionized state of the said column of gas produced by applying the dc potential and the ac electric field comprises unbound charge particles in a plasma.

3. The method as recited in claim 1 further comprising pressurizing said gas confined with the pressure vessel.

4. The method as recited in claim 1 wherein said ionizable gas introduced into and confined within the pressure vessel is an, inert gas.

5. The method as recited in claim 1 wherein said ionizable gas introduced into and confined within the pressure vessel is neon.

6. The method as recited in claim 1 wherein said ionizable gas introduced into and confined within the pressure vessel is argon.

7. The method as recited in claim 1, and:

said provided elongated pressure vessel having a length which is essentially an integer number of quarter-wavelengths of the rf energy desired to be radiated from an antenna of which said confined column of gas is the radiating element.

8. The method as recited in claim 1, and said provided elongated pressure vessel having a length which is essentially an integer number of half-wavelengths of the rf energy desired to be radiated from an antenna of which said column of gas is to be the radiating element.

9. The method as recited in claim 1 wherein the ac electric field applied to the column of gas within the elongated pressure vessel is a signal of a group of signal forms consisting of i) an am signal on a carrier frequency having frequency essentially equal to said pre-adjusted tuned natural resonance frequency, ii) an fm signal on a carrier frequency equal to said pre-adjusted natural resonance frequency, iii) a FSK signal on a carrier frequency equal to said pre-adjusted natural resonance frequency, and iv) a pulsed binary signal on a carrier frequency essentially equal to said pre-adjusted natural resonance frequency.

10. Confined plasma column antenna apparatus for radiating of energy comprising:

an elongated pressure vessel made of non-conductive material having a longitudinal axis;

a pair of electrodes disposed within said pressure vessel which respectively are disposed at opposite ends of the pressure vessel;

an ionized gas confined within said pressure vessel having a predetermined characteristic pre-adjusted tuning natural resonance frequency;

a gas ionization implementation dc source and a gas ionization implementation ac modulator, said dc source and said ac modulator cooperatively coacting to ionize the gas confined within said elongated pressure vessel to provide ionization of the gas in the pressure vessel;

said ionization implementation dc source applying a dc potential across said electrodes;

said gas ionization implementation ac modulator being operative to apply an ac electric field to the column of gas within the elongated pressure vessel, said ac electric field having a frequency essentially corresponding to said pre-adjusted natural resonance frequency, said electric field being applied to the column of gas along said longitudinal axis;

said gas ionization implementation dc source further being of a type which enables selective adjustment of the dc potential across the electrodes; and said confined column plasma antenna being tuned for gain through an adjustment of the dc potential applied across said electrodes to reduce the difference between the pre-adjusted natural resonance frequency and the frequency of the ac electric field applied by the gas ionization implementation ac modulator.

11. The apparatus as recited in claim 10 wherein said ionized gas confined within said elongated pressure vessel comprises unbounded charged particle in plasma.

12. Apparatus as recited in claim 10 wherein said ionized gas confined within the pressure vessel is pressurized.

13. Apparatus as recited in claim 10 wherein said ionized gas confined within the pressurized vessel is an inert gas.

14. Apparatus as recited in claim 10 wherein the ionized gas confined within the pressurized vessel includes ionized neon.

15. Apparatus as recited in claim 10 wherein the ionized gas confined within the pressure vessel includes ionized argon.

16. The apparatus as recited in claim 10, and:

said elongated pressure vessel is of a length equal to an integer number of quarter-wavelengths of the rf energy desired to be radiated from said antenna apparatus.

17. The apparatus as recited in claim 10, and:

said elongated pressure vessel is of a length essentially equal to an integer number of half-wavelengths of the rf energy desired to be radiated from said antenna apparatus if employed to radiate.

18. The apparatus as recited in claim 10 wherein the ac electric field applied to the column of gas within the elongated pressure vessel is a signal of a group of signal forms consisting of i) an am signal on a carrier frequency having frequency essentially equal to said pre-adjusted natural resonance frequency, ii) an fm signal on a carrier frequency equal to said pre-adjusted natural resonance frequency, iii) a FSK signal on a carrier frequency equal to said pre-adjusted natural resonance frequency, and iv) a pulsed binary signal on a carrier frequency essentially equal to said pre-adjusted natural resonance frequency.

* * * * *